US011754340B2

(12) United States Patent
Jirsa et al.

(10) Patent No.: US 11,754,340 B2
(45) Date of Patent: Sep. 12, 2023

(54) HEAT EXCHANGER TUBE

(71) Applicant: VALEO VYMENIKY TEPLA S. r. o., Zebrak (CZ)

(72) Inventors: Jakub Jirsa, Zebrak (CZ); Jan Forst, Zebrak (CZ); Florencio Gonzalez, Zebrak (CZ)

(73) Assignee: VALEO VYMENIKY TEPLA S. r. o., Zebrak (CZ)

( * ) Notice: Subject to any disclaimer, the term of this patent is extended or adjusted under 35 U.S.C. 154(b) by 122 days.

(21) Appl. No.: 17/059,793

(22) PCT Filed: May 29, 2019

(86) PCT No.: PCT/EP2019/064084

§ 371 (c)(1),
(2) Date: Nov. 30, 2020

(87) PCT Pub. No.: WO2019/229178

PCT Pub. Date: Dec. 5, 2019

(65) Prior Publication Data

US 2021/0207890 A1 Jul. 8, 2021

(30) Foreign Application Priority Data

May 30, 2018 (EP) ..... 18175180

(51) Int. Cl.
*F28D 1/03* (2006.01)
*F28D 21/00* (2006.01)

(52) U.S. Cl.
CPC .... *F28D 1/0341* (2013.01); *F28D 2021/0085* (2013.01)

(58) Field of Classification Search
CPC ..... F28D 1/0341; F28D 2021/0085; F28D 9/0037; F28D 1/0308; H01L 23/3736
See application file for complete search history.

(56) References Cited

U.S. PATENT DOCUMENTS 8,726,508 B2 * 5/2014 Zobel ..... B21C 37/151 165/177

FOREIGN PATENT DOCUMENTS

CN 1107567 A 8/1995
CN 1500198 A 5/2004
(Continued)

OTHER PUBLICATIONS

The First Office Action issued in Chinese Application No. 201980044422.X, dated Jan. 6, 2022 (14 pages).
(Continued)

*Primary Examiner* — Jon T. Schermerhorn, Jr.
(74) *Attorney, Agent, or Firm* — Osha Bergman Watanabe & Burton LLP

(57) ABSTRACT

The invention deals with a heat exchanger tube (1) for use in a heat exchanger tube (1) of a motor vehicle, the heat exchanger tube (1) comprising a pair (2) of plates (3) elongating along a longitudinal plan (A), the pair (2) of plates (3) comprising a first plate (3) and a second plate (4) joined to each other to form an inner area (5) dedicated to refrigerant fluid (RF) circulation and divided in at least six channels (6), at least one channel (6) is defined by a cross section area (S) that has a length (L), at least one of the plate is defined by a thickness (T) measured between an internal wall (7) of the plate and an external wall (8) of the plate opposed to the internal wall (7), wherein said thickness (T) is between 0.190 mm and 0.300 mm and said length (L) is between 2 mm and 5 mm.

12 Claims, 4 Drawing Sheets

(56) References Cited

FOREIGN PATENT DOCUMENTS

Figure 1:
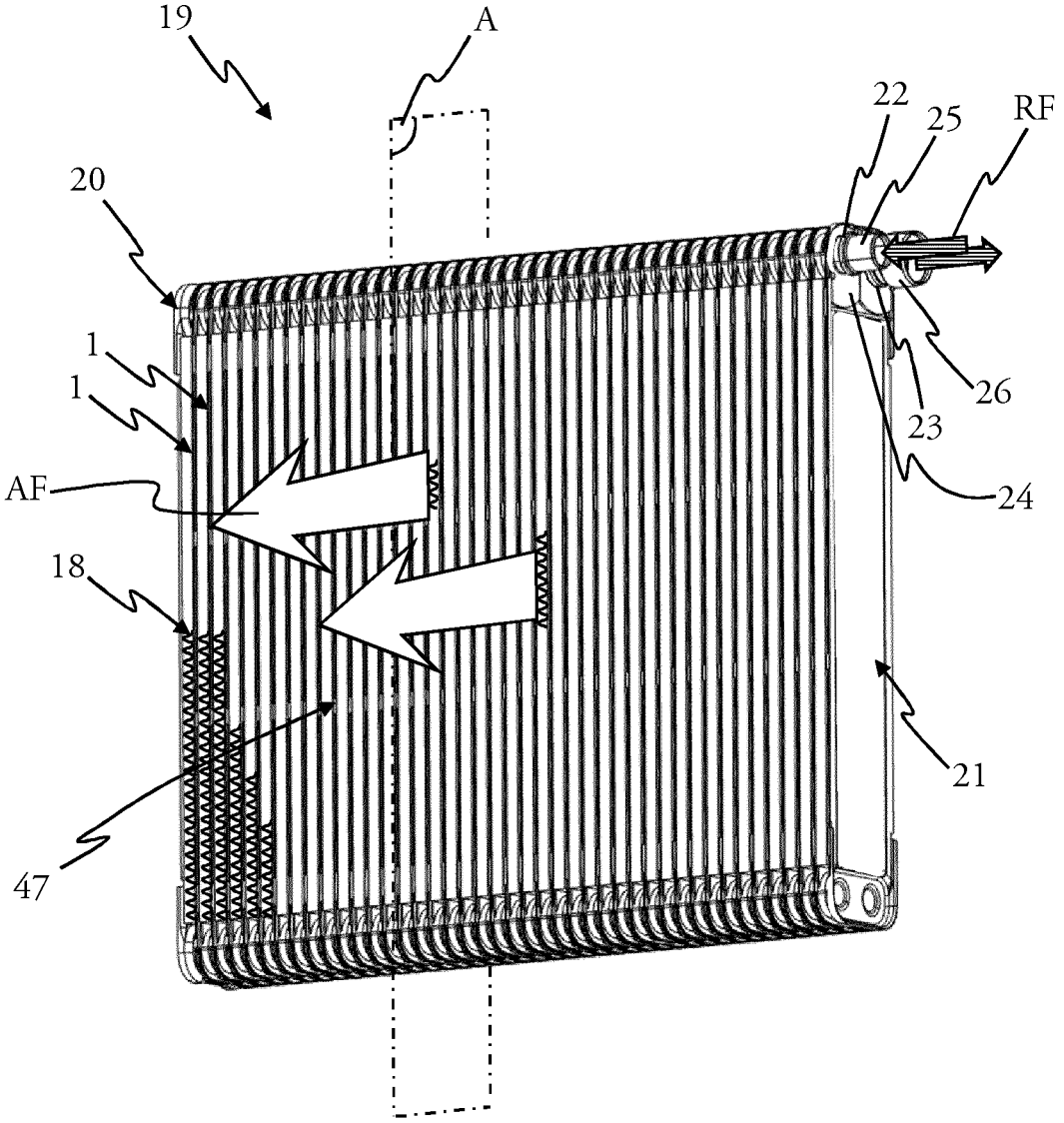

| | | | |
|---|---|---|---|
| CN | 1545608 | A | 11/2004 |
| CN | 101173841 | A | 5/2008 |
| EP | 0617250 | A2 | 9/1994 |
| FR | 2803377 | A1 | 7/2001 |
| JP | H0961084 | A | 3/1997 |
| JP | 2000130983 | A | 5/2000 |
| JP | 2002147983 | A | 5/2002 |
| KR | 20040007807 | A | 1/2004 |

OTHER PUBLICATIONS

International Search Report and Written Opinion corresponding to International Application No. PCT/EP2019/064084, dated Jul. 12, 2019 (9 pages).

* cited by examiner

HEAT EXCHANGER TUBE

The present invention relates to heat exchangers adapted to vehicle air conditioning systems. More specifically, the present invention deal with heat exchanger tubes used for such heat exchangers and heat exchangers using such heat exchanger tubes.

Heat exchangers adapted to vehicle air conditioning systems are commonly used as evaporators. They are adapted to cool down an air flow, and this air flow is then transferred to a passenger compartment of the vehicle or any component of the vehicle that need to be thermally controlled. For this purpose, heat exchangers are conventionally arranged in a Heating, Ventilation and Air-Conditioning (HVAC) device of the vehicle.

To cool down the air flow passing through it, heat exchanger comprises a refrigerant fluid circulation circuit. This refrigerant fluid circulation circuit generates heat exchange between said refrigerant fluid and the air flow.

In conventional heat exchangers, heat exchanger tubes are stacked one another with heat dissipating elements arranged in-between. The refrigerant fluid circulates inside the tubes, racking up calories of air flow passing through the dissipating elements of the heat exchanger.

Heat exchanger tubes can adopt various structures. According to the U.S. Pat. No. 6,241,011 document, heat exchanger tubes are defined by two different plates joined together by contact. Thanks to this contact, a pair of plates delimit a refrigerant fluid circulation area part of the refrigerant fluid circulation circuit. The junction of both plates is obtained by brazing, sealing the refrigerant fluid circulation area, except on an entry point and an exit point to allow the circulation of the refrigerant fluid in all the refrigerant fluid circulation circuit. Each plate has a shape designed to spread the refrigerant fluid flow in a U-shaped refrigerant fluid circulation area. This U-shaped has linear portions with long parallel areas, and a turn portion with projections where the refrigerant fluid is fully mixed.

Such design cannot optimize the fluid pressure loss inside the heat exchanger tube, since fluid internal pressure drop impact necessarily thermal exchange performances. The invention aims to provide a different heat exchanger tube in order to solve at least this problem, while providing a heat exchanger tube with a design easy to manufacture, at a lower cost and to achieve the best possible results in term of heat exchange.

For this purpose, the present invention provides a heat exchanger tube for use in a heat exchanger of a motor vehicle, the heat exchanger tube comprising a pair of plates elongating along a longitudinal plan, the pair of plates comprising a first plate and a second plate joined to each other to form an inner area dedicated to refrigerant fluid circulation and divided in at least six channels, at least one channel is defined by a cross section area delimited by the first plate and the second plate, the cross section area has a length, at least one of the plate is defined by a thickness, wherein said thickness is between 0.190 mm and 0.300 mm and said length is between 2 mm and 5 mm.

The heat exchanger tube is a flat tube dedicated to a heat exchanger. This flat tube is formed by assembling a pair of plates of globally rectangular shape. The longitudinal plan extends through the elongated heat exchanger tube. Both first plate and second plate extend in plans parallels to the longitudinal plan, thus making the tube planar.

The pair of plates is designed to allow the circulation of a refrigerant fluid in the dedicated inner area. The refrigerant fluid performs a heat exchange with an air flow when the heat exchanger is crossed by said air flow.

Both first plate and second plate have an internal wall and an external wall opposed to the internal wall. When the first plate and the second plate are assembled together, the internal wall of the first plate of a pair faces the internal wall of the second plate of the same pair. Then, the first plate and the second plate are brazed in order to delimit the inner area, except on an entry point and on an exit point to allow the refrigerant fluid to enter and exit.

The internal wall of the first plate and the internal wall of the second plate are in contact with each other on brazed areas. The pair of plates brazed forms the heat exchanger tube. Furthermore, the contact areas allows the formation of channels inside the heat exchanger tube. These channels split the inner area in order to spread out the circulating refrigerant fluid inside the heat exchanger tube. A homogeneous splitting provides a better heat exchange.

Each channel is defined by its proper cross section area. The cross section area is delimited by the internal wall of the first plate and the internal wall of the second plate. For said channel, the cross section area varies depending on the measurement location. Alternatively, the cross section area is constant for a same channel whatever the measurement location.

The cross section area is measured in a plan perpendicular to the longitudinal plan. The cross section area is calculated by multiplying the length and a height of the cross section area, and adding surfaces delimited by the two pairs of ridges of the considered channel. The cross section area defined for the present invention is dependent on both the length of the cross section area and the thickness of the plate.

Each plate is defined by its thickness. The thickness of a plate is a distance between the external wall and the internal wall of the same plate. The thickness is measured perpendicularly to longitudinal plan. For a said plate, the thickness varies depending on the measurement spot. Alternatively, the thickness is constant for the said plate whatever the measurement spot.

The length of the cross section area is specific of a channel and a measurement location of said length is related to the measurement location of the thickness: both measurements, i.e. thickness of plate and length of cross section area, are located in the same plan. The length of the cross section area is a distance measured on a plate, according to the longitudinal plan of the heat exchanger tube.

Thanks to such cross section area, an internal pressure drop measured in the inner area is reduced. In addition to this advantage, mechanical properties of plates are in the same time ensured, in particular regarding pressure, without increasing thickness of components. For example, these brazed tube resists to the maximum working pressure of 15 bars without deformation. It also resists to a burst pressure of 30 bars.

In accordance with the present invention, a length/thickness ratio is in range of 7.81 to 22.79. Even better mechanical properties of tube results from a plate thickness and a length of the cross section area both chosen to respect the ratio 7.81 to 22.79. No leak occurs at above mentioned pressures and no refrigerant fluid should flow outward the exchanger tube at working pressure.

In accordance with the present invention, the cross section area of the channel is between 2.76 $mm^2$ to 6 $mm^2$ per channel. The cross section area is in this range all along the channel.

We can also consider that the heat exchanger tube comprises a pair of plates elongating along a longitudinal axis, the pair of plates comprising a first plate and a second plate, the first plate is shaped with at least five ridges and the second plate is also shaped with at least five ridges, at least a ridge of the first plate is adapted to match a ridge of the second plate to generate a contact zone between first plate and second plate along considered ridges.

The term "match" is define as the concordance of ridges two by two, that fit to be brazed together. Ridges are placed in opposition each other to delimit the channel, each channel being defined by two ridges from both plates.

For example, the association of five ridges of the first plate with the other five ridges of the second plate generates a six channels heat exchanger tube.

It should be note that the first plate and the second plate are brazed on a peripheral region of the heat exchanger tube. This peripheral region differs from ridges, but also participates to establish the limit of inner area, at least for the two external channels. Consequently, the peripheral region participates to establish the limit of two channels. This explain the fact that five ridges are enough to obtain six channels, when the peripheral region in also implicated in the definition of channels.

In accordance with the present invention, the cross section area is delimited by a flat portion of the first plate, a flat portion of the second plate, a first pair of ridges and a second pair of ridges, each pair of ridges comprising a ridge of the first plate and a ridge of the second plate, two ridges of a pair being in contact with each other to define a contact zone. More specially, each ridge of the first plate is linked to the flat portion of the first plate thanks to a first ridge binding part, and each ridge of the second plate is linked to the flat portion of the second plate thanks to a second ridge binding part.

Thus, the cross section is delimited by the flat portion of the first plate, the flat portion of the second plate, the two first ridges of the first plate located on both sides of the flat portion of the first plate and the two second ridges of the second plate located on both sides of the flat portion of the second plate.

The association of a ridge of the first plate with a ridge of the second plate forms the contact zone of the pair. The two ridges of a pair are brazed in this contact zone. The first ridge binding part, the flat portion of the first plate, the second ridge binding part and the flat portion of the second plate are not in contact with each other.

A ridge comprises a contact zone surrounded by two ridges binding parts. In a pair of ridges, the ridges binding parts of the first plate and the ridges binding parts of the second plate extend in opposed sides, directed away from the contact zone of said pair. In a cross-sectional view, a ridge has a shape more or less flared, depending on the inclination of its ridges binding parts. Advantageously, ridges binding parts delimiting a given cross section area have the same size when they are part of a same plate. More advantageously, all the ridges binding parts delimiting a given cross section area have the same size.

This length is measured perpendicularly to the longitudinal axis of the pair of plates, in the longitudinal plan of the heat exchanger tube at the level of the internal wall.

In a preferred embodiment, at least one of the contact zone extends throughout a mid-longitudinal plan the heat exchanger tube. Advantageously, the mid-longitudinal plan of the heat exchanger tube is collocated with the longitudinal plan of the heat exchanger tube. Then, the mid-longitudinal plan corresponds to a longitudinal plan of symmetry of the heat exchanger tube, apart from the peripheral region of plates that comprises protrusions.

In accordance with the present invention, the channel has a steady cross section area all along the channel. "All along the channel" means that the cross section area is constant from one end to another end of the channel. The channel has the same cross section area lengthwise, at any location of the heat exchanger tube. By "the same", it must be understood that the cross section area S remains relatively constant for a channel. An increase or decrease up to 5% is admitted. Due to this regular section, the refrigerant fluid circulation is homogeneous from one end to the other end of the channel.

Advantageously, all channels of a heat exchanger tube have a steady cross section area. More advantageously, all channels of a heat exchanger tube have the same steady cross section area.

In accordance with the present invention, the thickness is below or equal to a width of the contact zone.

The width of the contact zone correspond to the width of the contact zone perpendicular to the longitudinal axis, in the longitudinal plan of the heat exchanger tube. This width separates two first ridges binding parts of a given pair of ridges of the same plate.

For a pair of ridges, the width of the contact zone varies depending on the measurement spot. Alternatively, the width of the contact zone is constant for a pair of ridges whatever the measurement spot. For said plate, the width of the contact zones of different pairs of ridges are different. Alternatively, the width of the contact zones of different pairs of ridges are similar on a same plate.

In accordance with the present invention, the inner area is divided in height channels. This require seven pairs of ridges in a heat exchanger tube. For a pair of plates with a determined surface, more channels provide consequently a better heat exchange.

In accordance with the present invention, the cross section area of all channels is between 2.76 $mm^2$ to 6 $mm^2$. Thus, in said channel, the refrigerant fluid distribution is homogeneous. Advantageously, all channels of a heat exchanger tube have the same cross section area.

In accordance with the present invention, both the first plate and the second plate have a constant thickness between 0.190 mm and 0.300 mm.

Advantageously, the thickness is regular at every point of each plate, keeping in mind the manufacturing tolerances. More advantageously, the thickness is the same on every measurement spots in a defined heat exchanger tube, regardless of which plate is considered.

In accordance with the present invention, the ridges of a pair of ridges are continuous lines between ridges ends to form the channel.

In this configuration, each ridge is continuous, that means a ridge is not fragmented. Thus, the contact zone of a pair is continuous all along ridges of said pair. If the two pairs of ridges on both sides of a channel are continuous, this channel is isolated, individualized lengthwise from other parts of the inner area, from the one end of the channel to the other end of the plate.

More advantageously, all ridges of the heat exchanger tube are continuous lines from the entry point to the exit point of a pair of plates. In this configuration, refrigerant fluid circulation area is divided in non-communicant channels.

In accordance with the present invention, a projection, on the longitudinal plan, of at least a channel, is U-shaped or straight from one end of the channel to the other end of said channel.

To form a U-shaped channel, at least a contact zone of ridges, alongside this channel, is U-shaped. In this U-shaped channel, the refrigerant fluid follows a first flow direction, and after a turn, follows a second flow direction, in an opposite sense to the first flow. Advantageously, a U-shaped channel is formed by two U-shaped contact zones. More advantageously, U-shaped ridges are nested. In a particular embodiment, one extremity of the U-shaped channel is the entry point, the other is the exit point of the heat exchanger tube.

Alternatively, to form a straight channel, both contact zones alongside this channel are straight. In this kind of channel, there is a unique straight flow of refrigerant fluid. Advantageously, contact zones are parallel to each other. In a particular embodiment, one extremity of the straight channel is the entry point, the other is the exit point of the heat exchanger tube.

In a specific embodiment of the present invention, the inner area is divided in at least six channels, the thickness of the plate is between 0.243 mm and 0.297 mm, the length of the cross section area is between 3.51 mm and 4.29 mm, the width of the contact zone is between 0.54 mm and 1.144 mm, a height of the cross section area is between 1.206 mm and 1.474 mm, and a width of the plate is between 34.2 mm and 41.8 mm.

The height of the cross section area is the distance between the internal wall of the first plate and the internal wall of the second plate. This height is measured in a direction perpendicular to the longitudinal plan of the heat exchanger tube.

The width of the plate is a transversal measure of the plate. This width is measured perpendicularly to the longitudinal axis of the pair of plates, in the longitudinal plan of the heat exchanger tube.

In a specific but non-exclusive example of achievement, the width of each plate is 38 mm, the inner area is divided in six channels, the thickness of both plates is equal to 0.27 mm and the length of the cross section area of all channels is 3.9 mm for a height of 1.34 mm. In this example, there is two kinds of ridges: a medial ridge separating two channels and other four ridges. The width of the medial contact zone is 1.04 mm, larger than the width of the other four contact zones that is 0.6 mm.

In a more specific embodiment of the present invention the inner area is divided in six channels and the ratio is in range of 11.67 to 22.79.

The present invention is also in accordance with another specific embodiment where an inner area divided in at least height channels, where the thickness of the plate is between 0.243 mm and 0.297 mm, the length of the cross section area is between 2 mm and 2.849 mm, the width of the contact zone is between 0.45 mm and 0.55 mm, the height of the cross section area is between 1.206 mm and 1.474 mm, and the width of the plate is between 34.2 mm and 41.8 mm.

In another specific but non-exclusive example of achievement, the width of each plate is 38 mm, the inner area is divided in eight channels and the thickness of both plates is equal to 0.27 mm. The length of the cross section area is variable for the channels: two are 2.11 mm in length, two are 2.29 mm in length and four are 2.59 in length, while all eight channels have a regular height of 1.34 mm. In this example, there is a unique kind of ridge with a width of contact zone of 0.5 mm.

The present invention also deal with a heat exchanger comprising a plurality of heat exchanger tubes as previously described, at least one dissipation device is located between two exchanger tubes, said dissipation device being corrugated with a pitch below or equal to 1.4 mm.

A heat exchanger is a stacking comprising an alternation between heat exchanger tubes and dissipation devices that extend in plan parallel to the longitudinal plan of the heat exchanger tube. The dissipation device is a heat dissipating element, for example fin. To ensure heat exchanges, the heat exchanger tube and the dissipation device are in direct contact, brazed with each other. Advantageously, only the flat portions of a plate of the heat exchanger tube are in contact, brazed with the dissipation device.

The dissipation device is design to be licked by the air flow, in order to cool it down thanks to the heat exchange that occurs with the refrigerant fluid. For this purpose, the dissipation device has a corrugated profile to increase the heat exchange surface area. Then, the dissipation device is characterized by a regular corrugation having a defined pitch. A pitch is the half of a distance between two adjacent corrugation crests. The pitch is measured in a longitudinal plan of the dissipation device, perpendicularly to the longitudinal axis of the pair of plates.

Figure 2:
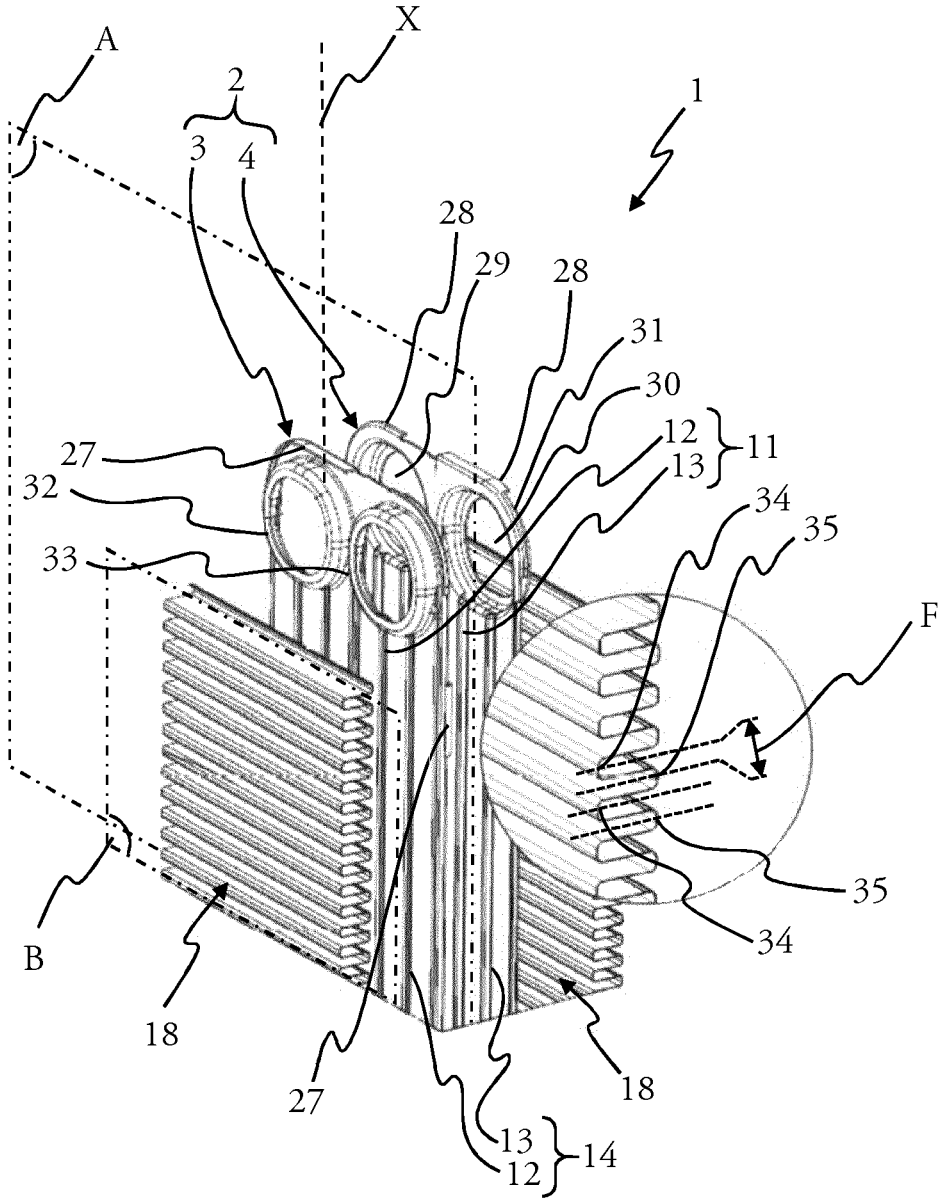
Figure 3:
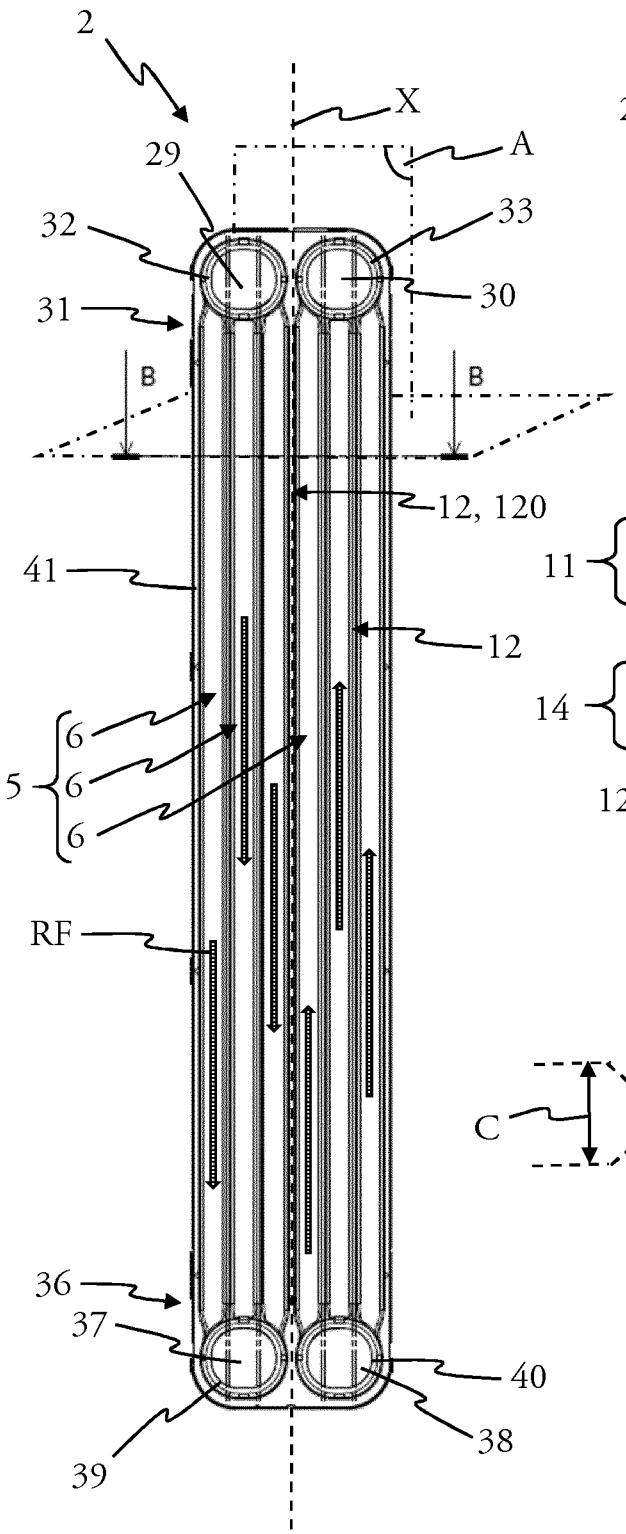
Figure 4:
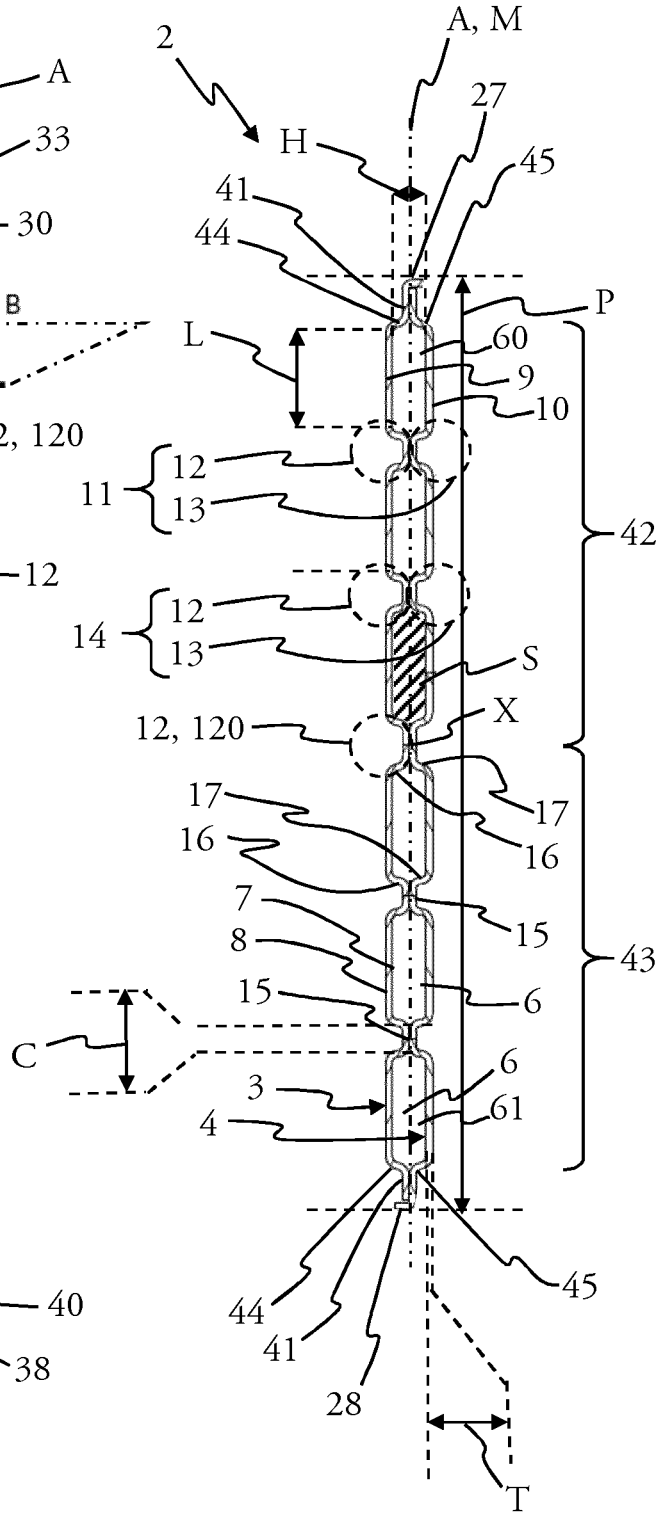
Figure 5:
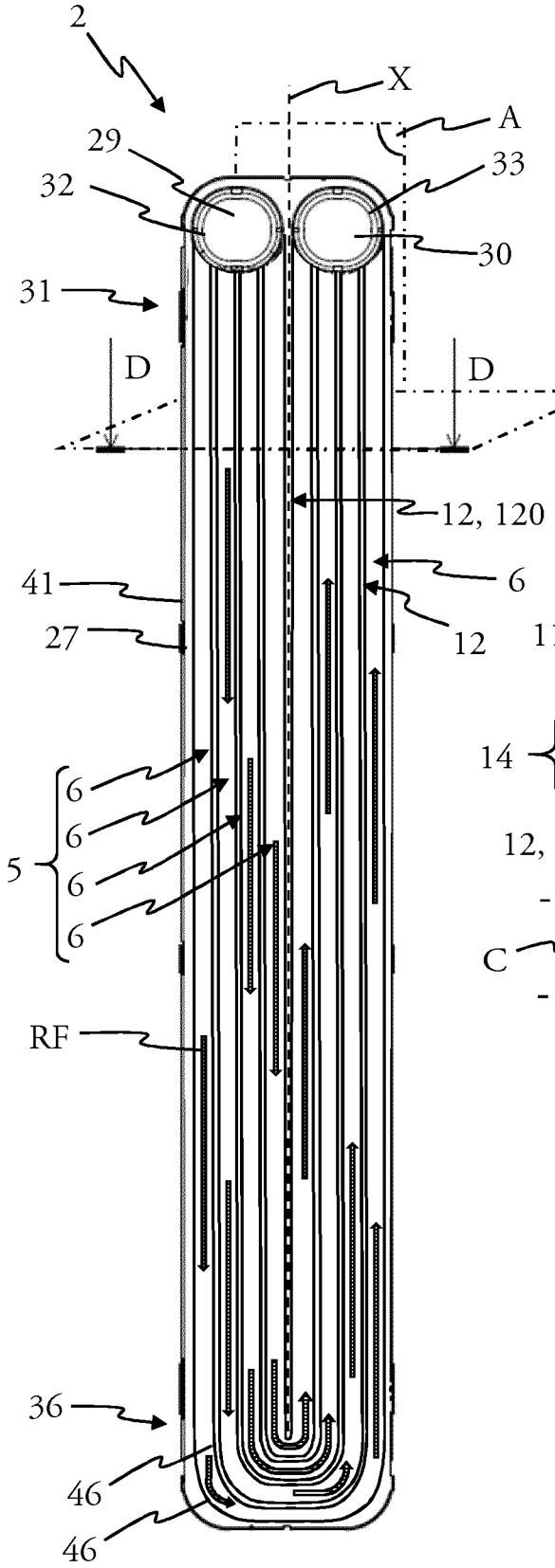
Figure 6:
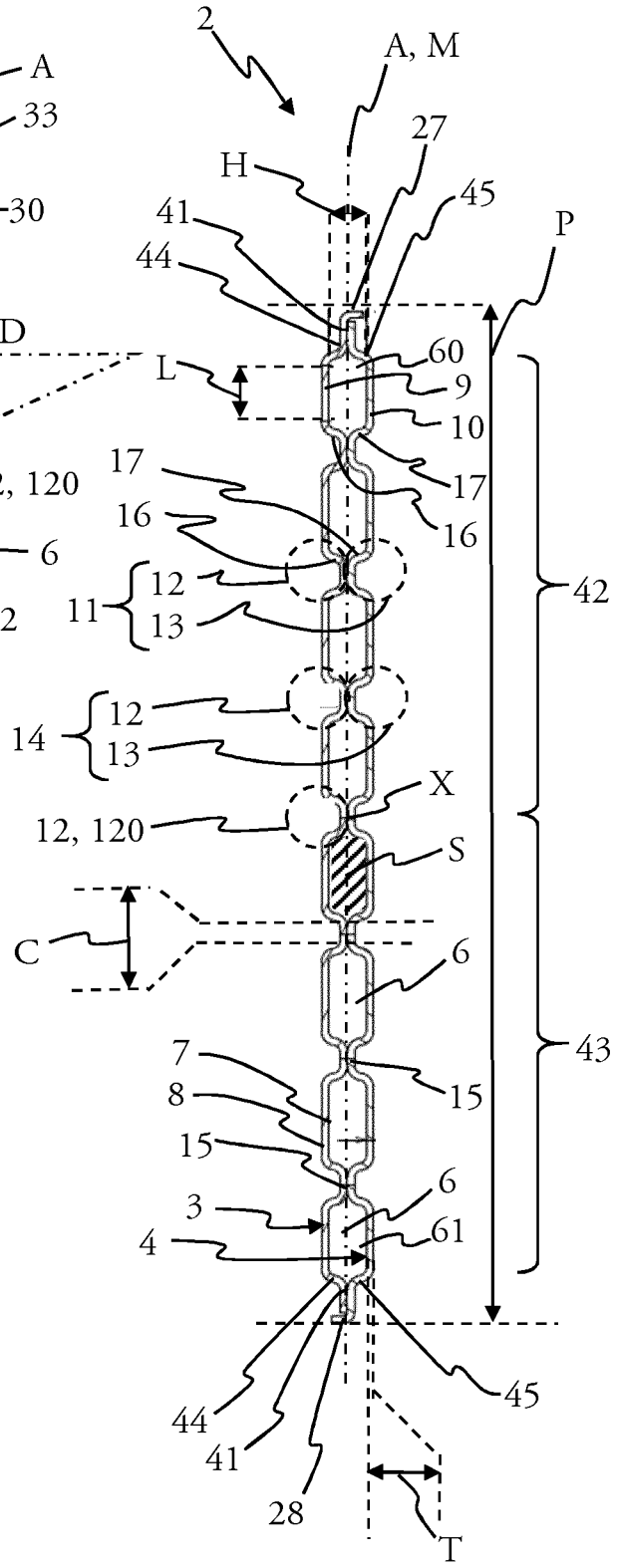

Other specificities, details and characteristics of the present invention will be highlighted thanks to the following description, given for general guidance, in relation with the following figures:

FIG. 1 is a general view of a heat exchanger including heat exchanger tubes according to the present invention, FIG. 2 is an exploded view of a heat exchanger tube according to the present invention, in a first embodiment, FIG. 3 is a front view of a heat exchanger tube according to the present invention shown in FIG. 2, FIG. 4 is a transversal section of the heat exchanger tube according to the present invention shown in FIGS. 2 and 3, FIG. 5 is a front view of a heat exchanger tube according to the present invention, in a second embodiment, FIG. 6 is a transversal section of the heat exchanger tube according to the present invention shown in FIG. 5.

Concerning dimensions, a length is a dimension measured in a direction where a considered element extends in its biggest way. A width or a height of the considered element are dimensions perpendicular to said length.

Note that features and different embodiments of the invention may be combined with one another in various combinations, as well as they are not incompatible or exclusive to one another. More particularly, it will be possible to imagine variants of the invention comprising only a selection of the features described hereinafter, without the other characteristics described, if said selection of features provides a technical advantage or if it allows to distinguish the invention over the prior art.

In particular, the embodiments described hereafter are combinable if said combination is functional from a technical point of view.

In the following figures, features common to several figures have the same reference.

Starting from FIG. 1, a plurality of heat exchanger tubes 1 of the invention are stacked in-between a plurality of dissipation devices 18. Both heat exchanger tubes 1 and dissipation devices 18 are oriented in parallel, according to a longitudinal plan A of one of the heat exchanger tubes 1.

Heat exchanger tubes 1 and dissipation devices 18 are integrated inside a heat exchanger 19 and alternately staked between two side mounting flanges 20, 21. Theses side mounting flanges 20, 21 also extend in a plan parallel to the longitudinal plan A of one of the heat exchanger tubes 1. Heat exchanger tubes 1 and dissipation devices 18 from a core 47 of the heat exchanger 19, said core 47 being the part which is crossed by an air flow AF and where the refrigerant fluid RF flows.

A first side mounting flange 20 is blind. A second side mounting flange 21, opposed to the first side mounting flange 20 versus the core 47, comprise two mouths 22, 23 at a same distal extremity 24 of the second side mounting flange 21. One mouth is a first mouth 22 that receives an input plug 25, the other mouth is a second mouth 23 that receives an output plug 26. The input plug 25 and the output plug 26 are intended to join the heat exchanger tubes 1 to a refrigerant circuit. The refrigerant fluid RF enter the heat exchanger 19 in liquid form thanks to the input plug 25. The refrigerant fluid RF is progressively vaporized inside heat exchanger tubes 1. The refrigerant fluid RF exit the heat exchanger 19 in gaseous form thanks to the output plug 26.

Each heat exchanger tube 1 has a globally flat shape. This shape optimize the heat exchange between heat exchanger tubes 1 and dissipation devices 18. Indeed, it ensure a good contact between heat exchanger tubes 1 and dissipation devices 18, since heat exchanger tubes 1 also supports the corrugated dissipation devices 18.

In the heat exchanger 19, heat exchange happened between the refrigerant fluid RF and the air flow AF crossing along the dissipation devices 18. The air flow AF licks heat exchanger tubes 1 and dissipation devices 18. The corrugated shape of dissipation devices 18 optimizes the heat transfer from the air flow AF to the refrigerant fluid RF, since it increases considerably heat exchange surfaces comparing to a non-corrugated device.

Circulating through the heat exchanger tubes 1 of the heat exchanger 19 operating as an evaporator, the refrigerant fluid RF collect calories from the air flow AF, and consequently cools this air flow AF down.

FIG. 2 illustrates the heat exchanger tube 1 according to the present invention and two adjacent dissipation devices 18.

The heat exchanger tube 1 has two plates 3, 4, a first plate 3 and a second plate 4, adapted to be joined and brazed. This two plates 3, 4 are constitutive of a pair 2 of plates 3, 4. The first plate 3 and the second plate 4 extend their wider dimension toward a longitudinal axis X of the pair 2 of plates 3, 4. This longitudinal axis X is included in the longitudinal plan A of the heat exchanger tube 1. The first plate 3 and the second plate 4 fit each other. Complementary protrusions 27, 28 extended crosswise the longitudinal plan A of the heat exchanger tube 1.

Each plate 3, 4 is veined with ridges 12, 13 that also extend toward the longitudinal axis X of the pair 2 of plates 3, 4. These ridges 12, 13 are continuous and straight lines. They form a pair 11, 14 of ridges 12, 13 when the first plate 3 and the second plate 4 are assembled one in contact on the other, in order to be brazed.

A plate 3, 4 has at least two openings 29, 30, a first opening 29 and a second opening 30, located at a same first distal extremity 31 of the heat exchanger tube 1. The first opening 29 and the second opening 30 are respectively surrounded by a first collar 32 and a second collar 33, in the manner of an eyelet, both the first collar 32 and the second collar 33 protruding from the longitudinal plan A of the heat exchanger tube 1. A second distal extremity 36 of the heat exchanger tube 1, visible on FIG. 3, comprise a third opening and a fourth opening 38 that are respectively surrounded by a third collar, and a fourth collar.

The first opening 29 and the second opening 30 are dedicated to refrigerant fluid RF circulation in order to connect different pairs 2 of plates 3, 4. For this purpose, the first collar 32 and the second collar 33 of a plate 3, 4 of pair 2 of plates 3, 4 match with the immediate adjacent first collar 32 and second collar 33 of an immediate adjacent plate 2 of another pair 2 of plates 3, 4. Then, first collars 32 and second collars 33 are in contact and brazed to seal an inner area dedicated to refrigerant fluid RF circulation, this inner area being called a collector.

The dissipation device 18 extends it wider dimension toward the longitudinal axis X of the pair 2 of plates 3, 4. Two dissipation devices 18 are distributed one both sides of the heat exchanger tube 1, in order to have a contact area between the plate 2 and the dissipation device 18. This contact area covers almost the entire plate 2, except at the first distal extremity 31 of the heat exchanger tube 1, on order to have, the first opening 29, the second opening 30, the first collar 32 and a second collar 33 free to face the other first opening 29, second opening 30, first collar 32 and second collar 33 of the immediate adjacent plates 2.

The dissipation device 18 is a single component that extends in a plan B parallel to the longitudinal plan A of the heat exchanger tube 1. The dissipation device 18 is regular in shape, with corrugations. The corrugated shape of a dissipation device 18 has periodic corrugation crests 34, 35 and a defined pitch F. Crests 34 face a plate 2 and crests 35 is design to face another plate 2. The periodic corrugation crests 34, 35 are symmetrical in relation to the plan B of the dissipation device 18. The pitch F is the distance between two adjacent corrugation crests 34, 35 on opposite sides of the plan B of the dissipation device 18. In other words, the pitch F is the half of a distance between two adjacent corrugation crests 34 or crest 35, crests 34 or crest 35 considered on the same side of the plan B of the dissipation device 18. The pitch F is measured according to the longitudinal axis X of the pair of plates between two adjacent corrugation crests 34 or crest 35.

FIG. 3 considers a pair 2 of plates 3, 4 of the heat exchanger tube 1 according to the present invention in the first embodiment illustrated in FIG. 2. As a result of the view angle, only one plate 3 of the pair 2 is visible. In this first embodiment, the plate 3 as an inner area 5 divided in six nearly identical straight channels 6. The sense followed by the refrigerant fluid RF is illustrated thanks to arrows.

The heat exchanger tube 1 extends toward the longitudinal axis X of the pair 2 of plate 3, 4. This heat exchanger tube 1 has two distal extremities, the first distal extremity 31, and the second distal extremity 36. Without considering the refrigerant fluid RF circulation, a plate 3 is symmetrical regarding to a plan passing throughout the longitudinal axis X and perpendicular to the longitudinal plan A of the heat exchanger tube 1, apart from a peripheral region 41 of plates 3, 4 that comprises the protrusions 27, 28.

The refrigerant fluid RF goes from first opening 29 and fourth opening 38 to, respectively, third opening 37 and second opening 30. The refrigerant fluid RF uses a straight path: from the first opening 29 to the third opening 37 and from the fourth opening 38 to the second opening 30, the refrigerant fluid RF is divided into three individualized flows, in three different channels 6.

The first opening 29, the second opening 30, the third opening 37 and the fourth opening 38 are respectively surrounded by the first collar 32, the second collar 33, the third collar 39, and the fourth collar 40. They are found at each distal extremities: the first opening 29 and the second opening 30 at the first distal extremity 31 of the heat exchanger tube 1, and the third opening 37 and the fourth opening 38 at the second distal extremity 36 of the heat exchanger tube 1. The first opening 29 and the second opening 30 are on each sides of the longitudinal axis X. The third opening 37 and the fourth opening 38 are also on each sides of the longitudinal axis X.

The first opening 29 and the second opening 30, or the third opening 37 and the fourth opening 38 are connected thanks to the straight channels 6. Three channels 6 connect the first opening 29 to the third opening 37. Three channels 6 connect the second opening 30 to the fourth opening 38.

Channels 6 are continuous lines, individualized lengthwise from each other. They are separated thanks to straight and continuous ridges 12. A ridge is larger than other ridges 12, measured in a plan perpendicular to the longitudinal plan A of the heat exchanger tube 1. This large ridge 12 is a ridge 12 named medial ridge 120. The medial ridge 120 is central, located on the longitudinal axis X.

The peripheral region 41 of the first plate 3 and of the second plate 4 of the heat exchanger tube 1 correspond to regions of contact of the first plate 3 with the second plate 4. This region of contact extends partially around the collars 32, 33, 39, 40, and also extend until the medial ridge 120. The peripheral region 41, the region of contact around collars 32, 33, 39, 40, the medial ridge 120 and other ridges 12 intend to be brazed to hermetically close the inner area 5 of the heat exchanger tube 1.

FIG. 4 details the pair 2 of plates 3, 4 of the heat exchanger tube 1 according to the present invention in the first embodiment illustrated in FIG. 3, according to a section view B-B transversally oriented regarding to the longitudinal plan A of the heat exchanger tube 1.

The heat exchanger tube 1 is made of the first plate 3 and of the second plate 4 brazed together. There are different zones of contact of the two plates 3, 4 contact zones 15 defined by a width C and the peripheral region 41 surrounding the pair 2 of plates 3, 4. This width C is measured perpendicularly to the longitudinal axis X, in the longitudinal plan A of the heat exchanger tube 1 at the level of the considered contact zone 15.

Thanks to these zones of contact 15, 41, the heat exchanger tube 1 houses six channels 6. Contact zones 15, 41 extend throughout the longitudinal plan A. More especially, contact zones 15, 41 extend throughout a mid-longitudinal plan M of the heat exchanger tube 1 collocated with the longitudinal plan A. The mid-longitudinal plan M correspond to a longitudinal plan of symmetry of the heat exchanger tube 1, apart from the peripheral region 41 of plates 3, 4 that comprises the protrusions 27, 28.

Each plate 2, 3 has an internal wall 7 and an external wall 8. Internal walls 7 of plates 3, 4 of a pair 2 of plates 3, 4 are face to face to couple their ridges 12, 13, in order to delimit channels 6. Each external walls 8 is dedicated to face a dissipation device 18 to promote thermal conductivity between the pair 2 of plates 3, 4 and the dissipation device 18.

The first plate 3 and the second plate 4 face their internal wall 7, opposed to their external wall 8. Zones of contact 15, 41 are on the internal wall 7 side. The first plate 3 and the second plate 4 are defined by the same thickness T measured between the internal wall 7 of said plate 3, 4 and the external wall 8 of said plate 3, 4. In the example illustrated in FIG. 4, the thickness T is 0.27 mm. Alternately, thickness of the first plate 3 may be different from the thickness of the second plate 4, as long as those thickness respect the range as claimed.

The internal wall 7 delimits the six channels 6. The channel 6 is then defined by a cross section area S delimited by the first plate 3 and the second plate 4. The channel 6 has the same cross section area S lengthwise, at any location of the heat exchanger tube 1.

All six channels 6 are almost identical surrounded by two flared shape ridges 12, 13, except the two channels 6 who are along an edge of the heat exchanger tube 1. These one are surrounded by a flared shape ridge 12, 13 and the peripheral region 41. Accurately, a first pair 11 of ridges 12, 13 and a second pair 14 of ridges 12, 13 surround four of the six channels 6.

A pair 11, 14 of ridges 12, 13 includes a ridge 12 of the first plate 3 matching with a ridge 13 of the second plate 4. All ridges 12, 13 are flared shape, widening from the contact zone 15 to a flat portion 9 of the first plate 3 or a flat portion 10 of the second plate 4.

The medial ridge 120 has a larger width C than other ridges 12. For example, the medial ridge 120 has a width C equal to 1.04 mm, and other ridges 12 have a width C equal to 0.6 mm. A group 42 of three channels 6 are aside the medial ridge 120 on one side of the longitudinal axis X, and another group 43 of three other channels 6 are aside the medial ridge 120 on the other side of the longitudinal axis X. In each channels 6 of any group 42, 43 of three channels 6, refrigerant fluid RF is circulating according to a unique trajectory. If comparing the refrigerant fluid RF trajectory inside the two groups 42, 43 of channels 6, the refrigerant fluid RF is circulating according to opposite trajectories in each group 42, 43.

Individually, for the channels 6 surrounded by two ridges 12, 13, we consider the following. The part of the ridge 12 of the first plate 3 connecting the contact zone 15 to the flat portion 9 of the first plate 3 is a first ridge binding part 16. The part of the ridge 13 of the second plate 4 connecting the contact zone 15 to the flat portion 10 of the second plate 4 is a second ridge binding part 17. In consequence, the said channel 6 is defined by a cross section area S delimited by the first binding part 16 of the first pair 11 of ridges 12, 13 of the first plate 3, the flat portion 9 of the first plate 3, the first ridge binding part 16 of the second pair 14 of ridges 12, 13 of the first plate 3, the second ridge binding part 17 of the first pair 11 of ridges 12, 13 of the second plate 4, the flat portion 10 of the second plate 4 and the second ridge binding part 17 of the second pair 14 of ridges 12, 13 of the second plate 4.

For the channels 6 surrounded by a pair of ridge 11, 14 and the peripheral region 41, we consider the following. The flat portion 9 of the first plate 3 and the flat portion 10 of the second plate 4 of this channel 6 are connected to the pair 11, 14 of ridge 12, 13 as above. The peripheral region 41 of the first plate 3 is linked to the flat portion 9 of the first plate 3 thanks to a first peripheral binding part 44. The peripheral region 41 of the second plate 4 is linked to the flat portion 10 of the second plate 4 thanks to a second peripheral binding part 45. In consequence, one of these channels 6, considered as a first peripheral channel 60, is defined by a cross section area S delimited by the first binding part 16 of the first pair 11 of ridges 12, 13 of the first plate 3, the flat portion 9 of the first plate 3, the first peripheral binding part of 44 the peripheral region 41 of the first plate 3, the second binding part 17 of the first pair 11 of ridges 12, 13 of the second plate 4, the flat portion 10 of the second plate 4 and the second peripheral binding part 45 of the peripheral region 41 of the second plate 4. The other channel 6, considered as a second peripheral channel 61, is defined by a cross section area S delimited by the first peripheral binding part 44 of the peripheral region 41 of the first plate 3, the flat portion 9 of the first plate 3, the first ridge binding part 16 of the second pair 14 of ridges 12, 13 of the first plate 3, the second peripheral binding part 45 of the peripheral region 41 of the second plate 4, the flat portion 10 of the second plate 4 and the second ridge binding part 17 of the second pair 14 of ridges 12, 13 of the second plate 4.

In addition, the cross section area S of a channel has a length L. The length L is measured along the longitudinal axis X of the pair of plates 3, 4 and in the longitudinal plan A of the heat exchanger tube 1 and of a plan passing through flat portion 9, 10 surrounded said channel 6, along a direction parallel to the longitudinal plan. The length L is the length of flat portions 9, 10 between binding parts:between the first peripheral binding part 44 and the first ridge binding part 16 or between the second peripheral binding part 45 and the second ridge binding part 17 or between the first ridge binding part 16 and the second ridge binding part 17. Here, the length L is regular for all channels 6 and is for example equal to 3.9 mm. Then, with a thickness T of 0.27 mm, the length L/thickness T ratio R is 14.44.

The cross section area S of a channel has also a height H. The height H is measured perpendicularly the longitudinal axis X in the plan perpendicular to the longitudinal plan A of the heat exchanger tube 1. The height H is a distance between the two internal walls 7 of a channel 6. Here, the height H is regular for all channels 6 and is for example equal to 1.34 mm.

The peripheral region 41 of both first plate 3 and second plate 4 ends with the complementary protrusions 27, 28. A complementary protrusion 27 of the first plate 3 extended crosswise the longitudinal plan A of the heat exchanger tube 1 in order to border the peripheral region 41 of the second plate 4. A complementary protrusion 28 of the second plate 4 extended crosswise the longitudinal plan A of the heat exchanger tube 1 in order to border the peripheral region 41 of the first plate 3. The complementary protrusion 28 of the second plate 4 extended in an opposed direction compared with the complementary protrusion 27 of the first plate 3.

A width P of the plate is measured according to the longitudinal plan A of the pair 2 of plates 3, 4 and perpendicularly to the longitudinal axis X, between the external wall 8 of the complementary protrusion 27 of the first plate 3 and the external wall 8 of the complementary protrusion 28 of the second plate 4. In the example of FIG. 4, width P is equal to 38 mm.

FIG. 5 shows a plate 3 of a pair 2 of plates 3, 4 of a second embodiment of the invention. In this second embodiment, the plate 3 as a U-shaped inner area 5 divided in height nearly identical straight channels 6 connected two by tow thanks to individual turn portions 46. The sense followed by the refrigerant fluid RF is illustrated thanks to arrows.

Except the number and shape of channels 6 and ridges 12, and the number and position of first openings 29, and second opening 30, the heat exchanger tube 1 describes in FIG. 5 is similar to the one described in FIG. 3. Then, to illustrate the FIG. 5, only differences with FIG. 3 will now be considered. For implementations, the reader has to refer to FIG. 3.

The first openings 29 and second opening 30 are surrounded respectively by the collar 32, 33. Openings 29, 30 are to be founded only at the first distal extremity 31 of the heat exchanger tube 1. There is no other opening, especially at the second distal extremity 36. The first openings 29 and second opening 30 are on each sides of the longitudinal axis X.

Ridges 12 divide the inner area 5 in eight nested parts, each parts having a U-shape. All ridges 12 have also a U-shape in the longitudinal plan A and go from the first opening 29 to the second opening 30, except for the ridge that is central which is straight and end to the second distal extremity 36.

The first openings 29 and second opening 30 are connected thanks to nested parts of the inner area 5. A nested part include two straight channels 6 linked by the turn portion 46. Then, a refrigerant fluid RF uses following U-path: entry thanks to the first opening 29, divided into four individualized flows, a flow goes through a channel 6, a turn portion 46 and another channel 6, before exiting the second opening 30 at the same first distal extremity 31.

Regarding the dimensions, the width P is equal to 38 mm, the thickness T is equal to 0.27 mm and the height H is equal to 1.4 mm. The width C is identical for all ridges and is equal to 0.5 mm.

The length L is variable, and so is the ratio R. The first peripheral channel 60 and the second peripheral channel 61 have both a length L equal to 2.1 mm then the length L/thickness T ratio R is 7.82. Both channels 6 on both sides of the medial ridge 120 have a length L equal to 2.29 mm then the length L/thickness T ratio R is 8.48. And the four other channels 6 have a length L equal to 2.59 mm, then the length L/thickness T ratio R is 9.59.

FIG. 6 details the pair 2 of plates 3, 4 of the heat exchanger tube 1 according to the present invention in the second embodiment illustrated in FIG. 5, according to a section view D-D transversally oriented regarding to the longitudinal plan A of the heat exchanger tube 1.

Except the number of channels 6, height instead of six, and ridges 12, 13, seven instead of five, the heat exchanger tube 1 viewed in cross section describes in FIG. 6 is similar to the one described in FIG. 4. We consider that the width C is almost identical for all pair 11, 14 of ridges 12, 13. Then, to illustrate the FIG. 6 and for implementations, the reader has to refer to FIG. 5.

We understand thanks to the above description, that the present invention proposes a simple design of heat exchanger tube for use in heat exchanger used as evaporator in a motor vehicle. This heat exchanger tube is easily manufactured, at a low cost. It allows good thermal exchange performances and reduce the refrigerant fluid pressure drop thanks to individualized channels constituting the inner. Furthermore, this design is resistant at working pressure and burst pressure, for a long term sustainability. This heat exchanger tube is dedicated to heat exchanger and can be found in a Heating, Ventilation and Air-Conditioning device of the vehicle. This kind of heat exchanger can be easily integrated into vehicle air conditioning systems in order to optimize the heat exchange between the air flow dedicated to the passenger compartment cool down and the refrigerant fluid circulating inside heat exchanger tubes of the invention.

However, the invention is not limited to resources and patterns described and illustrated here. It also include all equivalent resources or patterns and every technical associations including such resources. More particularly, the shape of the heat exchanger tube do not affect the invention, insofar as the heat exchanger tube for use in a motor vehicle, in fine, has the same functionality as describes in this document.

The invention claimed is:

1. A heat exchanger tube for use in a heat exchanger of a motor vehicle, the heat exchanger tube comprising:

a pair of plates elongating along a longitudinal plan, the pair of plates comprising a first plate and a second plate joined to each other to form an inner area dedicated to refrigerant fluid circulation and divided in at least six channels, at least one channel is defined by a cross section area delimited by the first plate and the second plate, the cross section area has a length, and at least one of the plates is defined by a thickness, wherein the thickness of each plate is between 0.190 mm and 0.300 mm and the length of the cross section area is between 2 mm and 5 mm, wherein all of the at least six channels have the same cross section area, wherein each plate comprises at least two openings located at a first distal extremity and at least two openings located at a second distal extremity, wherein for each plate, a plurality of straight channels connect the at least two openings at the first distal extremity with the at least two openings at the second distal extremity, and wherein for each plate, the refrigerant fluid is divided into at least three individualized flows in at least three different straight channels.

2. The heat exchanger tube according to claim 1, wherein a length/thickness ratio is in a range of 7.81 to 22.79.

3. The heat exchanger tube according to claim 1, wherein the cross section area of each channel is between 2.76 $mm^2$ to 6 $mm^2$.

4. The heat exchanger tube according to claim 2, wherein the cross section area is delimited by a flat portion of the first plate, a flat portion of the second plate, a first pair of ridges and a second pair of ridges, each pair of ridges comprising a ridge of the first plate and a ridge of the second plate, two ridges of a pair being in contact with each other to define a contact zone.

5. The heat exchanger tube according to claim 4, wherein each ridge of the first plate is linked to the flat portion of the first plate by way of a first ridge binding part, and each ridge of the second plate is linked to the flat portion of the second plate by way of a second ridge binding part.

6. The heat exchanger tube according to claim 4, wherein at least one of the contact zones extends throughout a mid-longitudinal plan of the heat exchanger tube.

7. The heat exchanger tube according to claim 4, wherein the thickness is below or equal to a width of the contact zone.

8. The heat exchanger tube according to claim 4, wherein the ridges of a pair of ridges are continuous lines between ridges ends to form each channel.

9. The heat exchanger tube according to claim 7, wherein the inner area is divided in at least six channels, the thickness of the plate is between 0.243 mm and 0.297 mm, the length of the cross section area is between 3.51 mm and 4.29 mm, the width of the contact zone is between 0.54 mm and 1.144 mm, a height of the cross section area is between 1.206 mm and 1.474 mm, and a width of the plate is between 34.2 mm and 41.8 mm.

10. The heat exchanger tube according to claim 9, wherein the inner area is divided in six channels and the ratio is in range of 11.67 to 22.79.

11. The heat exchanger tube according to claim 7, wherein the inner area is divided in at least height channels, the thickness of the plate is between 0.243 mm and 0.297 mm, the length of the cross section area is between 2 mm and 2.849 mm, the width of the contact zone is between 0.45 mm and 0.55 mm, the height of the cross section area is between 1.206 mm and 1.474 mm, and the width of the plate is between 34.2 mm and 41.8 mm.

12. A heat exchanger comprising:

a plurality of heat exchanger tubes, each of which comprises:

a pair of plates elongating along a longitudinal plan, the pair of plates comprising a first plate and a second plate joined to each other to form an inner area dedicated to refrigerant fluid circulation and divided in at least six channels, at least one channel is defined by a cross section area delimited by the first plate and the second plate, the cross section area has a length, and at least one of the plates is defined by a thickness, wherein the thickness of each plate is between 0.190 mm and 0.300 mm and the length of the cross section area is between 2 mm and 5 mm;

wherein all of the at least six channels have the same cross section area, wherein each plate comprises at least two openings located at a first distal extremity and at least two openings located at a second distal extremity, wherein for each plate, a plurality of straight channels connect the at least two openings at the first distal extremity with the at least two openings at the second distal extremity, and wherein for each plate, the refrigerant fluid is divided into at least three individualized flows in at least three different straight channels; and at least one dissipation device being located between two exchanger tubes, the dissipation device being corrugated with a pitch below or equal to 1.4 mm.

* * * * *